US006764205B2

(12) United States Patent
Peloquin

(10) Patent No.: US 6,764,205 B2
(45) Date of Patent: Jul. 20, 2004

(54) PIGTAIL LIGHTED CHRISTMAS ORNAMENT

(75) Inventor: Bruce C. Peloquin, Milford, MA (US)

(73) Assignee: Four Star International Trading Company, Taipei (TW)

( * ) Notice: Subject to any disclaimer, the term of this patent is extended or adjusted under 35 U.S.C. 154(b) by 0 days.

(21) Appl. No.: 10/113,196

(22) Filed: Mar. 29, 2002

(65) Prior Publication Data

US 2003/0185015 A1 Oct. 2, 2003

(51) Int. Cl.[7] ..... F21V 17/06

(52) U.S. Cl. ..... 362/437; 362/121; 362/122; 362/806; 428/7; 428/11

(58) Field of Search ..... 362/565, 806, 362/437, 124, 809, 267, 121, 122; 428/7, 11, 542.2

(56) References Cited

U.S. PATENT DOCUMENTS 4,693,541 A * 9/1987 Sanders et al. ..... 439/541
4,833,580 A * 5/1989 Allen ..... 362/451
RE34,717 E * 9/1994 Sanders et al. ..... 315/186
5,822,088 A * 10/1998 Danno et al. ..... 359/1
6,224,230 B1 * 5/2001 Roegiers ..... 362/123

* cited by examiner

*Primary Examiner*—Stephen Husar
*Assistant Examiner*—Sharon Payne
(74) *Attorney, Agent, or Firm*—Brian M. Dingman, Esq.; Mirick, O'Connell, DeMallie & Lougee, LLP

(57) ABSTRACT

A pigtail lighted ornament with a blown glass ornament body, a pigtail electrical cord, a light electrically coupled to one end of the cord, a pigtail electrical connector at the other end of the cord, for connection to a receiving socket, for supplying power to the light, a first opening in the ornament body through which the cord passes, a second opening defined in the ornament body, and a soft grommet seated in the second opening and defining a seat in which the light is held so that the light is held securely, but removably coupled to the outside of the ornament body, and to allow the pigtail electrical connector to be plugged into a pigtail-style light strand.

6 Claims, 1 Drawing Sheet

PIGTAIL LIGHTED CHRISTMAS ORNAMENT

FIELD OF THE INVENTION

This invention relates to Christmas ornaments.

BACKGROUND OF THE INVENTION

There are many types of Christmas ornaments, including lighted ornaments. One type of ornament is what is called a "soft sculpture" which is typically a molded, rubbery plastic material. Some of these are designed to carry a light by different manners of coupling of a light to the soft body. The lights are sometimes of the "pigtail" style which end in a small plug-in electrical connector that is adapted to fit into a pigtail socket of a pigtail-style Christmas light strand.

Problems with these types of ornaments start with their appearance. The soft sculpture has a particular appearance which is considered relatively low-end, and the style limits the quality of detail, in that these molds typically cannot show fine detail. Also, since the material is not clear and is at most translucent, they cannot be lighted from the inside.

Another problem with these ornaments is that the pigtail cord is visible, which detracts from the overall appearance of the ornament.

SUMMARY OF THE INVENTION

It is therefore a primary object of this invention to accomplish a better looking, finer quality, blown glass, pigtail-style lighted Christmas ornament.

It is a further object of this invention to provide such an ornament in which the pigtail electrical cord is largely hidden from view.

A preferred object of this invention is to provide such a lighted ornament in which the light can project from the ornament virtually at any desired location.

This invention features a pigtail, lighted ornament, comprising: a blown glass ornament body; a pigtail electrical cord; a light electrically coupled to one end of the cord; a pigtail electrical connector at the other end of the cord, for connection to a receiving socket, for supplying power to the light; a first opening in the ornament body through which the cord passes; a second opening defined in the ornament body; and a soft grommet seated in the second opening and defining a seat in which the light is held so that the light is held securely, but removably coupled to the outside of the ornament body, and to allow the pigtail electrical connector to be plugged into a pigtail-style light strand.

The grommet may define a central longitudinal groove, defined by opposed flexible surfaces, and wherein the ornament body defining the second opening has a rim thickness, wherein the groove has a relaxed opening width less than the rim thickness, so that the opposed flexible surfaces grip the ornament body. The pigtail light may comprise a lamp in a lamp socket, and wherein the lamp socket has a peripheral shape and size, and wherein the grommet seat defines an opening for the lamp socket, the seat opening being slightly smaller than, and generally the same shape as, the lamp socket periphery, to tightly but removably grip the lamp socket. The grommet may be of a soft rubber.

The cord may be knotted within the body, so the knot being larger than the second opening so that the cord cannot be easily pulled through the second opening. The ornament may further comprise an ornament hanger engaged with the first opening, so that the ornament can be hung from a Christmas tree branch.

BRIEF DESCRIPTION OF THE DRAWINGS

Other objects, features and advantages will occur to those skilled in the art from the following description of the preferred embodiments, and the accompanying drawings, in which.

DETAILED DESCRIPTION OF THE PREFERRED EMBODIMENTS

The invention may be accomplished in a pigtail lighted ornament. The ornament is comprised of a hollow, blown-glass ornament body that carries a light. It comprises a lamp held in a lamp socket. The socket is held in the body in a soft grommet that is held in an opening in the blown glass ornament body. The grommet tightly but removably grips the lamp socket. The cord passes through the hollow body and exits the body through another opening, which is preferably the opening that also carries the ornament hanger. The cord ends in a pigtail electrical connector so that it can be plugged into a pigtail socket of a pigtail-style Christmas light strand. This allows the ornament to be placed on a Christmas tree anywhere near the location of a light strand. Also, the lamp can be easily replaced by withdrawing the socket from the grommet, replacing the lamp, and then pushing the socket back into the grommet. Preferably, the pigtail cord has a knot or other enlargement that inhibits its being fully withdrawn through the grommet.

Figure 3:
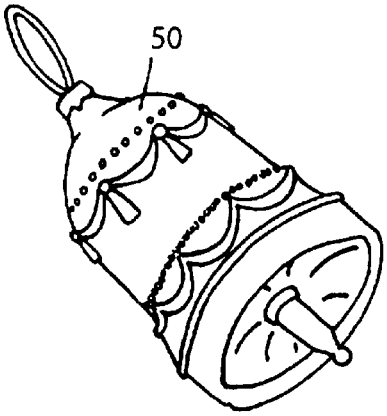
FIG. 3 is a perspective view of a bell-shaped ornament of this invention.
Figure 1:
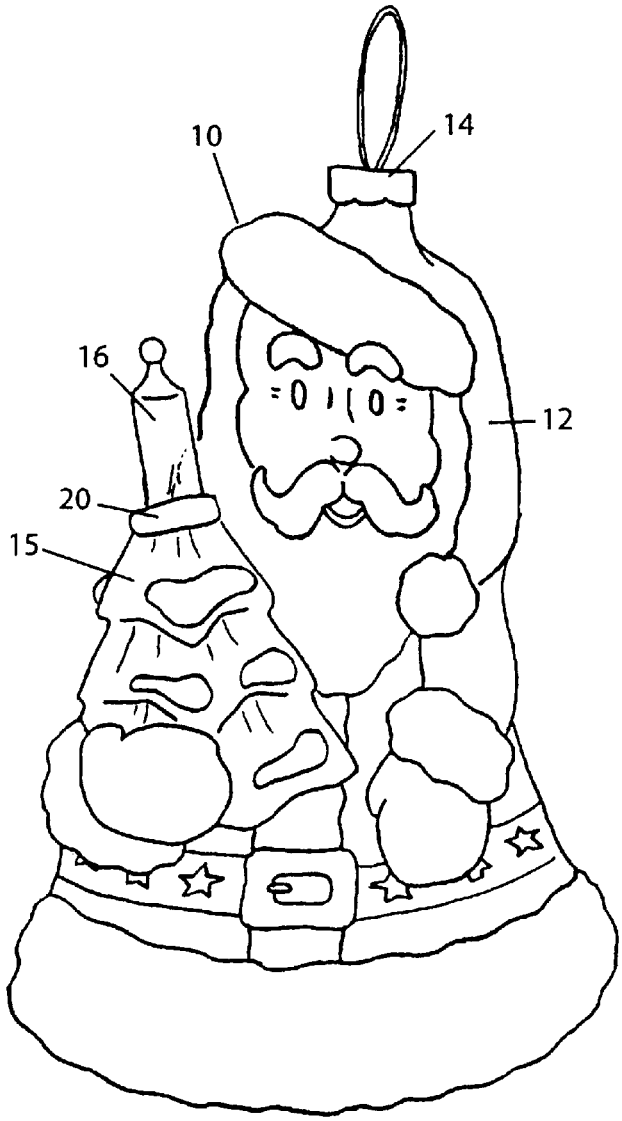
FIG. 1 is a front view of a Santa pigtail lighted ornament of this invention.

FIG. 1 depicts Santa-style blown glass pigtail, lighted ornament 10, according to this invention. Blown glass ornament body 12 in this embodiment has the shape of Santa Claus. Blown glass ornament 50, FIG. 3, has the shape of a bell. The particular shape of the ornament body is not important to the invention, as the shape can be virtually any shape that can be made of glass construction. Body 12 is substantially hollow. Lamp 34 projects from body 12 and is held in place as is explained below, using soft grommet 20 that is seated in an opening in body 12, which in this case is placed at the top of the tree 15 held by the Santa figure. Ornament hanger 14 allows the ornament to be hung from a Christmas tree.

Figure 2B:
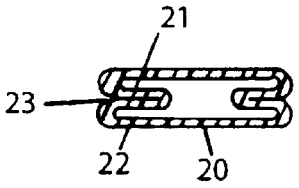
FIG. 2B is an enlarged cross-sectional view of the grommet of FIG. 2A.
Figure 2A:
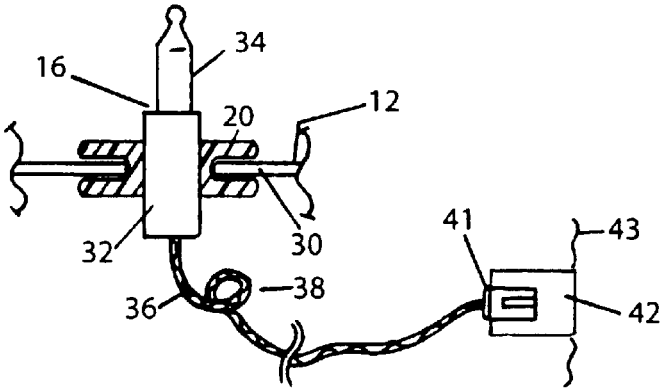
FIG. 2A is a greatly enlarged schematic cross-sectional diagram of the pigtail light and the manner in which it is held in the ornament for the embodiment of FIG. 1.

The construction is best depicted in FIGS. 2A and 2B. The pigtail light 16 comprises lamp 34 held in lamp socket 32. Pigtail electrical cord 36 preferably has knot 38 therein, and at its other end pigtail electrical connector 41 that is adapted to fit into and electrically connect to pigtail receiving socket 42 in Christmas tree light strand 43. This is the means of supplying power to lamp 34.

Light 16 is held in body 12 as follows. Opening 30 is created in body 12. Preferably, this opening is circular. A soft grommet 20 is seated in opening 30. Preferably, the grommet defines central longitudinal groove 23 defined by opposed flexible surfaces 21, 22, FIG. 2B, that define a central longitudinal groove 23 that, in the relaxed state (not inserted into the ornament body) as shown in FIG. 2B, has a width less than the thickness of the rim 30 of the opening of body 12 into which grommet 20 fits. This arrangement causes the opposed flexible surfaces of grommet 20 to grip the ornament body so that it doesn't easily pull out of the body.

Also as shown in FIG. 2A, the grommet 20 defines an opening which, in the relaxed state, is slightly smaller in diameter than the diameter of lamp socket 32. This arrangement tightly but removably grips socket 32 so that lamp 34 is held in the proper location.

Although specific features of the invention are shown in some drawings and not others, this is for convenience only as some feature may be combined with any or all of the other features in accordance with the invention.

Other embodiments will occur to those skilled in the art and are within the following claims.

What is claimed is:

1. A pigtail, lighted ornament, comprising:

a blown glass ornament body;

a pigtail electrical cord;

a light electrically coupled to one end of the cord;

a pigtail electrical connector at the other end of the cord, for connection to a receiving socket, for supplying power to the light;

an opening defined in the ornament body; and a grommet seated in the opening, wherein the grommet defines a central longitudinal groove, defined by opposed flexible surfaces, and wherein the ornament body defining the opening has a rim thickness, wherein the groove has a relaxed opening width less than the rim thickness, so that the opposed flexible surfaces grip the ornament body, the grommet defining a seat in which the light is held so that the light is held securely, but removably coupled to the outside of the ornament body, and to allow the pigtail electrical connector to be plugged into a pigtail-style light strand.

2. The pigtail, lighted ornament of claim 1, wherein the pigtail light comprises a lamp in a lamp socket, and wherein the lamp socket has a peripheral shape and size, and wherein the grommet seat defines an opening for the lamp socket, the seat opening being slightly smaller than, and generally the same shape as, the lamp socket periphery, to tightly but removably grip the lamp socket.

3. The pigtail, lighted ornament of claim 1, wherein the grommet is of rubber.

4. The pigtail, lighted ornament of claim 1, wherein the cord is knotted within the body, the knot being larger than the opening so that the cord cannot be easily pulled through the opening.

5. The pigtail, lighted ornament of claim 1, further comprising an ornament hanger engaged with the ornament body, so that the ornament can be hung from a Christmas tree branch.

6. A pigtail, lighted ornament, comprising:

a blown glass ornament body;

a pigtail electrical cord;

a light electrically coupled to one end of the cord;

a pigtail electrical connector at the other end of the cord, for connection to a receiving socket, for supplying power to the light;

an opening defined in the ornament body;

a grommet of rubber seated in the opening, wherein the grommet defines a central longitudinal groove, defined by opposed flexible surfaces, and wherein the ornament body defining the opening has a rim thickness, wherein the groove has a relaxed opening width less than the rim thickness, so that the opposed flexible surfaces grip the ornament body, the grommet defining a seat in which the light is held so that the light is held securely, but removably coupled to the outside of the ornament body, and to allow the pigtail electrical connector to be plugged into a pigtail-style light strand;

wherein the pigtail light comprises a lamp in a lamp socket, and wherein the lamp socket has a peripheral shape and size, and wherein the grommet seat defines an opening for the lamp socket, the seat opening being slightly smaller than, and generally the same shape as, the lamp socket periphery, to tightly but removably grip the lamp socket; and an ornament hanger engaged with the ornament body, so that the ornament can be hung from a Christmas tree branch.

* * * * *